US010107582B2

(12) United States Patent
Gray et al.

(10) Patent No.: US 10,107,582 B2
(45) Date of Patent: Oct. 23, 2018

(54) QUICK CONNECT RIFLE RECEIVER ADAPTER SYSTEM

(71) Applicants: Scott Gray, Bushnell, FL (US); Nathan Love, Bushnell, FL (US)

(72) Inventors: Scott Gray, Bushnell, FL (US); Nathan Love, Bushnell, FL (US)

( * ) Notice: Subject to any disclaimer, the term of this patent is extended or adjusted under 35 U.S.C. 154(b) by 276 days.

(21) Appl. No.: 14/959,793

(22) Filed: Dec. 4, 2015

(65) Prior Publication Data

US 2017/0160037 A1 Jun. 8, 2017

(51) Int. Cl.
*F41A 21/48* (2006.01)

(52) U.S. Cl.
CPC ..... *F41A 21/482* (2013.01)

(58) Field of Classification Search
CPC ..... F41A 3/66; F41A 21/48; F41A 21/484; F41A 21/481; F41A 11/00; F41A 11/02; F41A 21/00; F41A 35/00; F41A 19/15; F41A 21/32; F41A 21/325; F41A 3/30; F41A 21/482; F41C 27/06
See application file for complete search history.

(56) References Cited

U.S. PATENT DOCUMENTS 255,523 A * 3/1882 Lightburne, Jr. ..... F16L 37/252 285/110
1,994,489 A * 3/1935 Simpson ..... F41A 21/482 42/1.07
3,236,155 A * 2/1966 Sturtevant ..... F41A 3/18 89/199
4,765,224 A * 8/1988 Morris ..... F41A 5/26 42/75.02
4,920,679 A 5/1990 Sarles et al.
5,020,260 A * 6/1991 Houghton ..... F41A 11/04 42/75.01
5,356,183 A * 10/1994 Cole ..... F16L 25/0045 285/148.27
5,412,895 A * 5/1995 Krieger ..... F41A 21/482 42/75.02
5,500,484 A 3/1996 Monney et al.
5,509,345 A * 4/1996 Cyktich ..... F41A 21/325 42/97
5,559,302 A * 9/1996 Latka ..... F41A 21/325 89/14.05
5,590,484 A * 1/1997 Mooney ..... F41G 1/16 42/111
5,685,102 A * 11/1997 Latka ..... F41A 21/325 42/76.01
5,987,797 A * 11/1999 Dustin ..... F41A 21/482 42/75.02
6,295,751 B1 * 10/2001 Piwonski ..... F41A 21/00 42/1.15

(Continued)

*Primary Examiner* — Troy Chambers
*Assistant Examiner* — Bridget A Cochran
(74) *Attorney, Agent, or Firm* — Thomas Frost

(57) ABSTRACT

The present invention is a quick connect receiver adapter assembly for an automatic or semi-automatic rifle, specifically the AR-15 assault rifle. The adapter system is used to quickly exchange barrels on an AR-15 rifle platform, and allows the user to convert the AR-15 from a single caliber weapon to a multi-caliber weapon. The system has a receiver attached portion comprising a three piece locking ring assembly, and separate barrel adapter assembly which can be attached to any caliber barrel suitable for use with the AR-15 assault rifle.

7 Claims, 10 Drawing Sheets

(56) References Cited

U.S. PATENT DOCUMENTS 6,499,245 B1 * 12/2002 Swan ..... F41C 23/00 42/124
6,606,812 B1 * 8/2003 Gwinn, Jr. ..... F41A 21/484 42/75.02
6,655,372 B1 12/2003 Field et al.
6,671,990 B1 * 1/2004 Booth ..... F41C 23/16 42/75.01
6,694,660 B1 * 2/2004 Davies ..... F41A 21/482 42/71.01
6,959,509 B2 11/2005 Vais
RE39,465 E * 1/2007 Swan ..... 42/124
7,444,775 B1 11/2008 Schuetz
7,523,580 B1 * 4/2009 Tankersley ..... F41C 23/16 42/71.01
7,578,423 B1 8/2009 Duan et al.
7,661,349 B1 * 2/2010 Brittingham ..... F41A 21/30 181/223
7,726,060 B1 * 6/2010 Jones ..... F41A 3/66 42/75.02
7,735,406 B1 * 6/2010 Olson ..... F41A 21/325 89/14.3
7,770,317 B1 * 8/2010 Tankersley ..... F41C 23/16 42/71.01
7,789,009 B1 * 9/2010 Brittingham ..... F41A 21/325 181/223
7,827,722 B1 * 11/2010 Davies ..... F41A 3/94 42/71.01
7,905,041 B1 * 3/2011 Davies ..... F41A 3/66 42/75.02
8,037,633 B1 * 10/2011 Troy ..... F41C 23/16 42/71.01
8,046,949 B1 * 11/2011 Daniel ..... F41C 23/16 42/71.01
8,087,194 B1 * 1/2012 Vuksanovich ..... F41A 21/48 42/75.01
8,201,487 B2 * 6/2012 Dueck ..... F41A 21/26 42/96
8,205,373 B1 * 6/2012 Ubl ..... F41A 11/02 42/71.01
8,230,633 B1 * 7/2012 Sisk ..... F41C 23/06 42/75.01
8,234,808 B2 * 8/2012 Lewis ..... F41A 3/26 42/71.01
8,276,304 B2 * 10/2012 Samson ..... F41C 23/16 42/112
8,291,805 B1 10/2012 Quilligan
8,453,364 B2 * 6/2013 Kucynko ..... F41C 23/16 42/71.01
8,479,429 B2 7/2013 Barrett et al.
8,490,535 B1 * 7/2013 Moore ..... F41A 21/34 181/223
8,499,676 B1 * 8/2013 Moore ..... F41A 21/26 42/90
8,539,708 B2 9/2013 Kenney et al.
8,689,478 B2 4/2014 Patel
8,726,559 B1 5/2014 Mueller
8,739,449 B2 * 6/2014 Patel ..... F41C 23/16 42/75.02
8,763,510 B2 * 7/2014 Dueck ..... F41A 21/26 89/14.4
8,782,943 B2 7/2014 Jarboe
8,839,545 B1 * 9/2014 Gangl ..... F41A 11/00 42/75.03
8,863,426 B1 * 10/2014 Zinsner ..... F41C 23/16 42/71.01
8,919,025 B2 12/2014 Kuczynko
8,950,546 B2 * 2/2015 Shults ..... F41A 21/30 181/223
8,959,821 B1 * 2/2015 Calvert ..... F41A 21/18 42/76.01
9,010,009 B2 * 4/2015 Buxton ..... F16B 37/047 42/71.01
9,057,576 B2 6/2015 Barrett et al.
9,140,506 B2 * 9/2015 Gomez ..... F41A 21/487
9,383,154 B2 * 7/2016 Stone ..... F41A 21/481
9,448,027 B1 * 9/2016 Zinsner ..... F41A 21/482
9,464,857 B2 * 10/2016 Lessard ..... F41A 21/30
9,476,672 B2 * 10/2016 Wells ..... F41C 23/16
9,658,020 B2 * 5/2017 Daniel ..... F41A 21/485
2001/0049996 A1 * 12/2001 Fluhr ..... F41A 21/30 89/14.4
2004/0049964 A1 * 3/2004 Vais ..... F41A 21/482 42/75.02
2005/0081707 A1 * 4/2005 Herring ..... F41A 5/26 89/33.14
2006/0010748 A1 * 1/2006 Stoner ..... F41C 27/00 42/71.01
2006/0060076 A1 * 3/2006 Dueck ..... F41A 21/30 89/14.4
2007/0017139 A1 * 1/2007 Larue ..... F41A 21/482 42/75.1
2007/0033851 A1 * 2/2007 Hochstrate ..... F41A 5/18 42/75.01
2007/0199435 A1 * 8/2007 Hochstrate ..... F41A 3/66 89/191.02
2010/0095575 A1 * 4/2010 Swan ..... F41C 23/16 42/72
2010/0313743 A1 * 12/2010 Dueck ..... F41A 21/325 89/14.05
2010/0319231 A1 * 12/2010 Stone ..... F41C 23/16 42/71.01
2011/0000119 A1 * 1/2011 Desomma ..... F41A 3/66 42/75.02
2011/0016762 A1 * 1/2011 Davies ..... F41A 21/487 42/75.01
2011/0061281 A1 * 3/2011 Kapusta ..... F41C 23/16 42/71.01
2011/0192066 A1 * 8/2011 Kimmel ..... F41C 23/16 42/71.01
2011/0247254 A1 * 10/2011 Barnes ..... F41A 21/48 42/71.01
2012/0073179 A1 * 3/2012 Young ..... F41A 21/485 42/75.02
2012/0131834 A1 * 5/2012 Barrett ..... F41A 3/26 42/75.02
2012/0131835 A1 * 5/2012 Barrett ..... F41A 3/26 42/75.02
2012/0186123 A1 * 7/2012 Troy ..... F41C 23/16 42/71.01
2012/0216439 A1 * 8/2012 Barrett ..... F41A 3/26 42/75.02
2012/0311908 A1 * 12/2012 Kenney ..... F41A 21/482 42/75.02
2012/0324775 A1 * 12/2012 Troy ..... F41C 23/16 42/71.01
2013/0139424 A1 * 6/2013 Devine ..... F41A 3/26 42/16
2013/0180151 A1 * 7/2013 Moore ..... F41C 27/00 42/90
2014/0026459 A1 * 1/2014 Yan ..... F41C 23/16 42/71.01
2014/0033590 A1 * 2/2014 Gomez ..... F41A 21/48 42/75.02
2014/0068987 A1 * 3/2014 Burt ..... F41C 23/16 42/16
2014/0075817 A1 * 3/2014 Gomez ..... F41A 21/48 42/75.02
2014/0115938 A1 * 5/2014 Jarboe ..... F41A 21/485 42/71.01
2014/0345179 A1 * 11/2014 Adair ..... F41C 23/16 42/75.02
2015/0007478 A1 * 1/2015 Barrett ..... F41A 21/481 42/75.02
2015/0198403 A1 * 7/2015 Bentley ..... F41A 21/484 42/75.02
2015/0266168 A1 * 9/2015 Geissele ..... B25B 13/48 29/525.11

(56) References Cited

U.S. PATENT DOCUMENTS

| | | | | |
|---|---|---|---|---|
| 2015/0308779 | A1* | 10/2015 | McGinty | F41A 21/484<br>42/75.02 |
| 2015/0369555 | A1* | 12/2015 | Daniel | F41A 21/485<br>42/75.02 |
| 2016/0054096 | A1* | 2/2016 | Dzwill | F41C 23/16<br>42/75.02 |
| 2016/0091276 | A1* | 3/2016 | Miller | F41C 23/16<br>42/75.02 |
| 2016/0116251 | A1* | 4/2016 | Mather | F41A 21/482<br>42/71.01 |
| 2016/0348990 | A1* | 12/2016 | Steil | F41A 5/18 |
| 2016/0356567 | A1* | 12/2016 | Bybee | F41A 13/10 |
| 2017/0108303 | A1* | 4/2017 | Gomez | F41A 21/48 |

* cited by examiner

QUICK CONNECT RIFLE RECEIVER ADAPTER SYSTEM

FIELD OF THE INVENTION

The present invention relates to an improved rifle receiver adapter system for changing barrels of rifles, particularly for an AR-15 based assault rifle.

BACKGROUND OF INVENTION

The AR-15 assault rifle has been in production since 1959, first by ArmaLite, then Colt, and in the preceding years by any number of firearms manufacturers. It was used as the basis for the iconic M-16, and a multitude of other semi-automatic, and automatic rifles. In the intervening years it has become near ubiquitous, and as such the many variants of the basic AR-15 platform come in a variety of sizes, calibers, and barrel lengths. The varieties include not less than 8 different barrel lengths, ranging from 24 inches down to 6.5 inches, and over 65 calibers can be fired using the basic AR-15 platform. In addition to those choices, an AR-15 owner literally has thousands of aftermarket add-ons from which to choose including hand grips, sights, scopes, lasers, lights, and rails for attaching this multitude of accessories. As a result, the AR-15 is perhaps the most versatile and customizable firearm platform on the market today.

In light of this, the present invention is an adapter which replaces the barrel nut assembly on an AR-15 platform. This adapter allows the user to quickly change barrel systems without special tools. The ability to change barrels is the key to modularity for the AR-15 platform; as the barrel holds the chamber and the chamber determines the caliber.

SUMMARY OF THE INVENTION

The present invention is a system for allowing the user to quickly and easily exchange barrels on the AR-15 assault rifle platform. In the present invention there is a Receiver Adapter Assembly, and a Barrel Adapter Assembly. The Receiver Adapter Assembly comprises a three piece unit which includes a threaded locking collar, a partially threaded receiver adapter, and a lock ring; where the lock ring has multiple locking bayonet slots. The Barrel Adapter Assembly comprises a barrel nut replacement with multiple threaded apertures for holding set screws and multiple smooth apertures for individually holding multiple locking lugs.

In use, an AR-15 is separated into receiver and barrel components, and the barrel is stripped. The Receiver Adapter Assembly is attached to the upper receiver of the rifle by first attaching the locking collar to the barrel end of the receiver, the receiver adapter is threaded on the receiver to secure the locking collar, and the lock ring is threaded onto the lock collar. The Barrel Adapter Assembly is threadably attached to the receiver end of the stripped AR-15 barrel. The Receiver Adapter Assembly and the Barrel Adapter Assembly are aligned and fit together such that the lugs of the Barrel Assembly Adapter are aligned with and inserted into the bayonet slots, and the two assemblies are rotated with respect to one another in order to ensure a mechanical interlock between the upper receiver and the barrel assembly.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
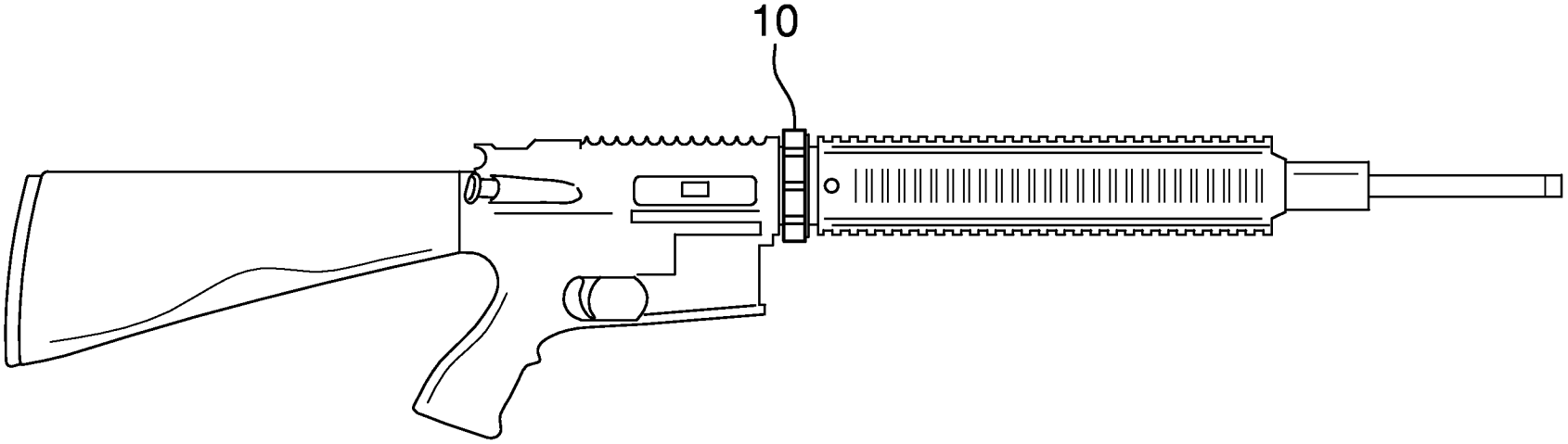
FIG. 1 is a view of the invention in use.

Referring to the drawings in general, the present invention will now be described in greater detail.

Figure 2:
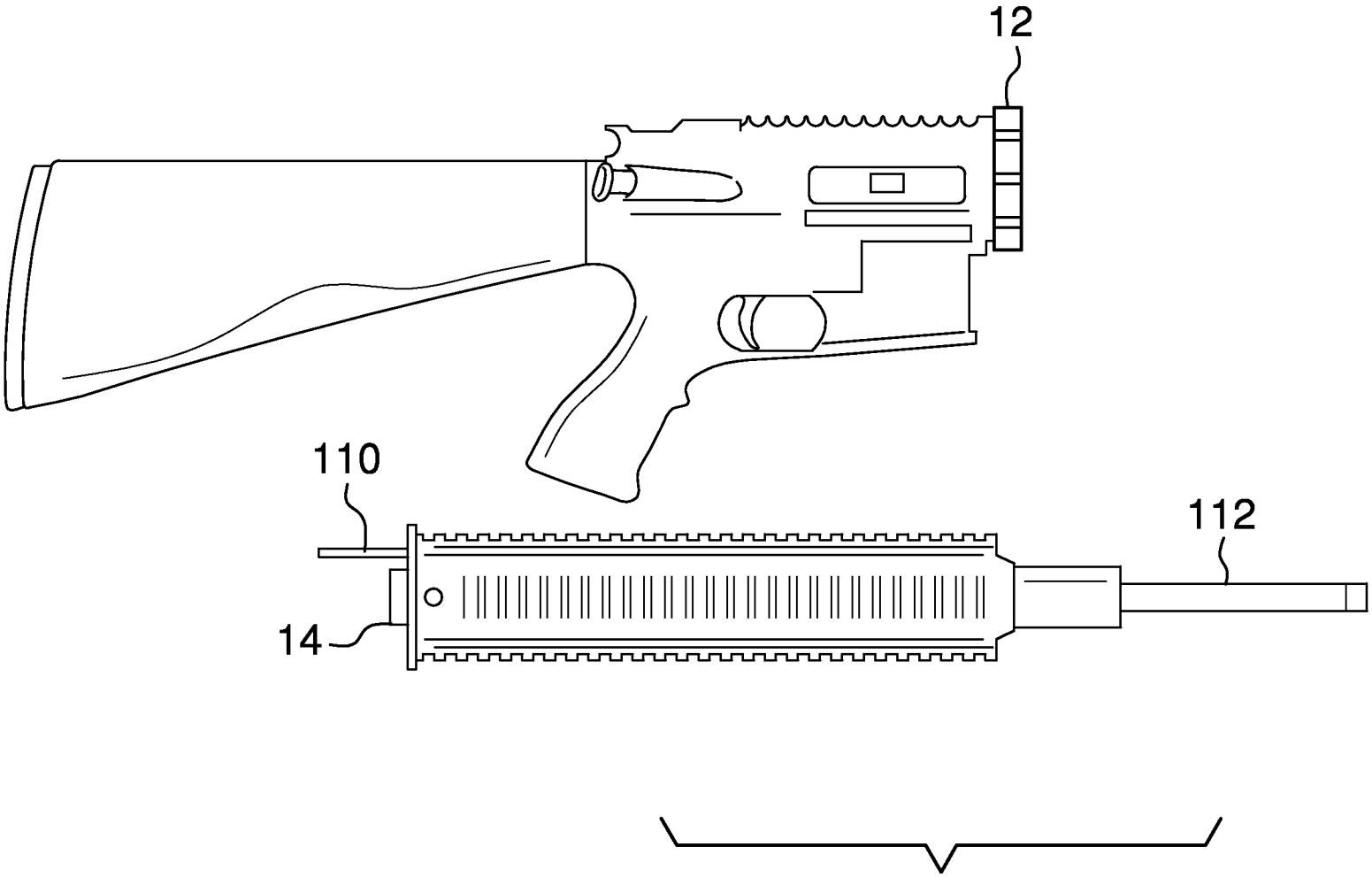
FIG. 2 is a view of the invention separated into receiver and barrel assemblies.
Figure 3:
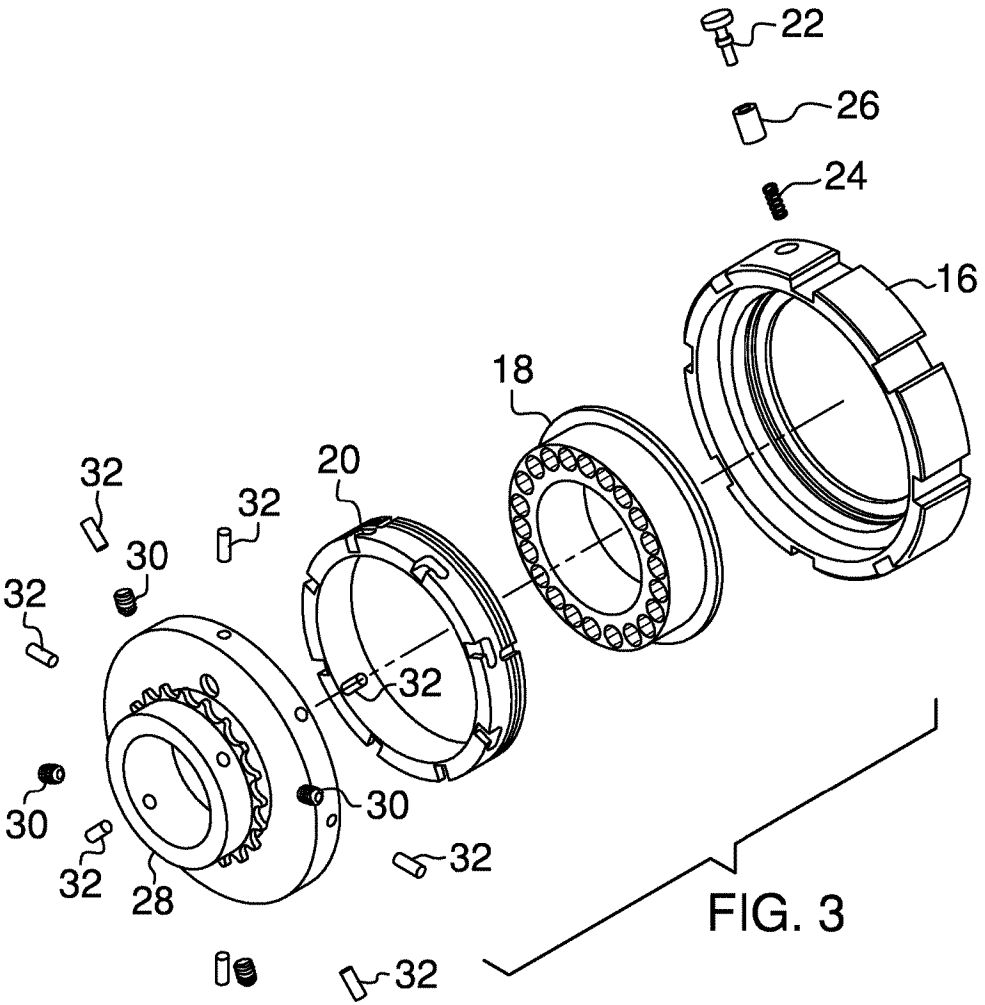
FIG. 3 is an exploded view of the invention.
Figure 4:
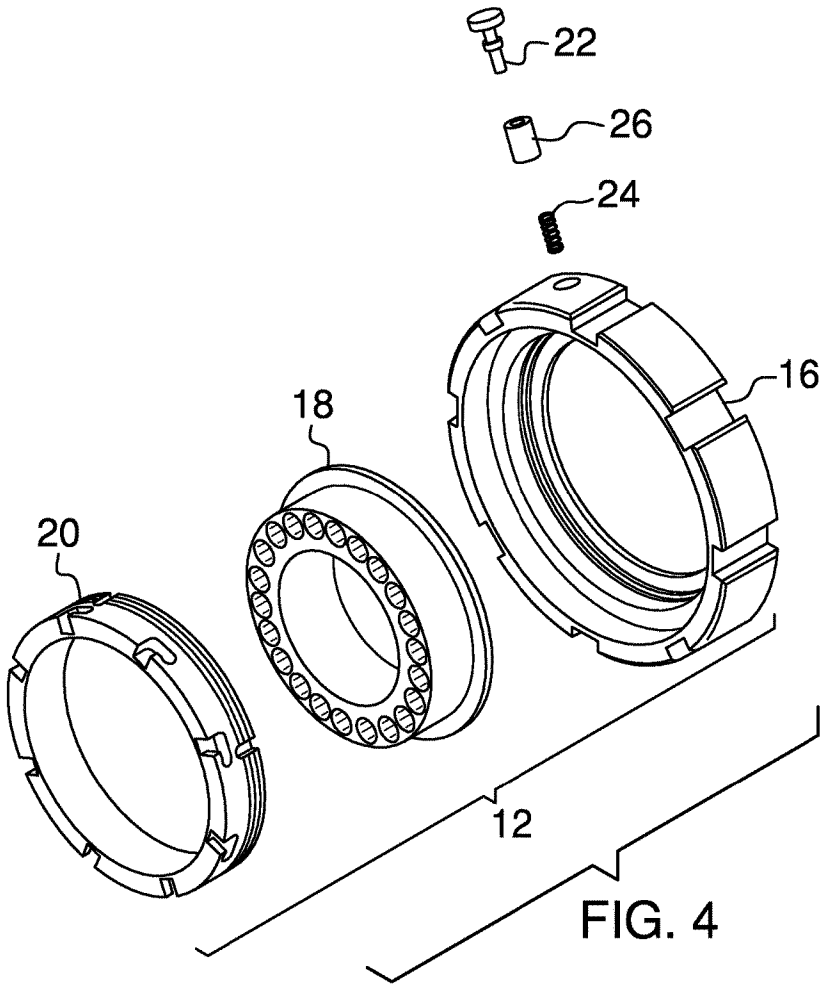
FIG. 4 is an exploded view of the Receiver Adapter Assembly.
Figure 5A:
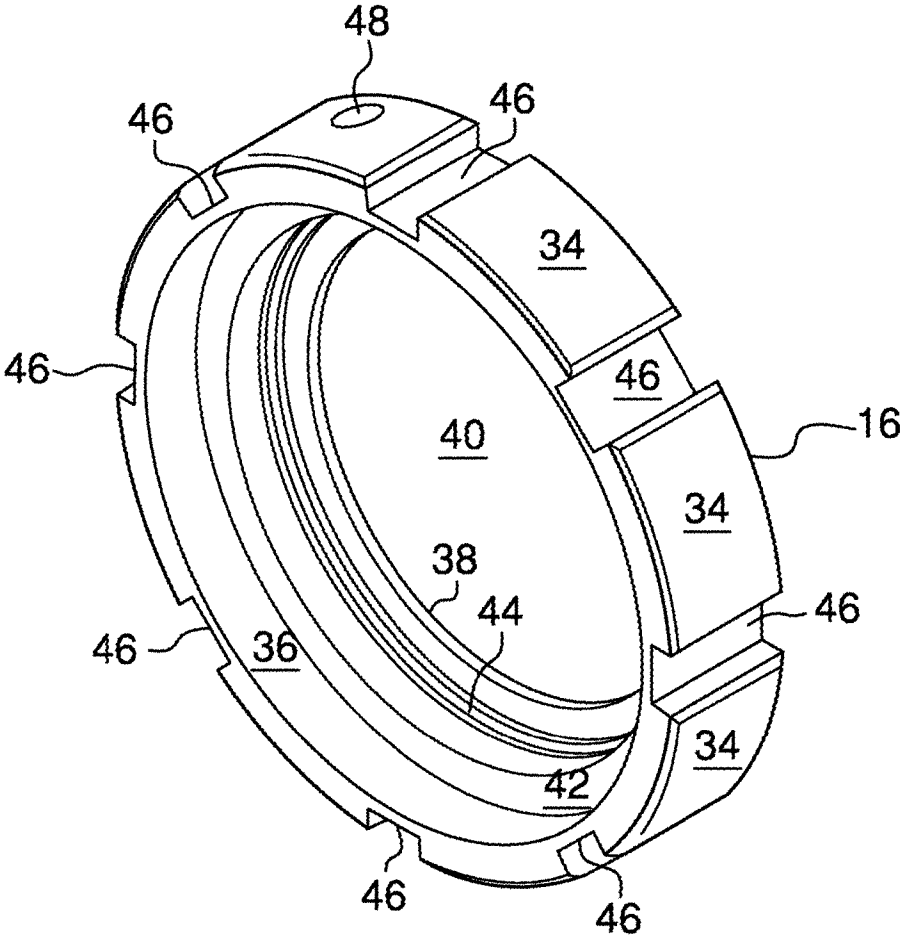
FIGS. 5*a-d* are views of the Locking Collar Assembly and its constituent parts.
Figure 5D:
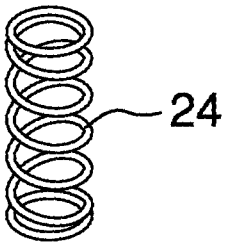
Figure 5C:
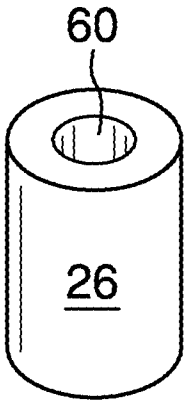
Figure 5B:
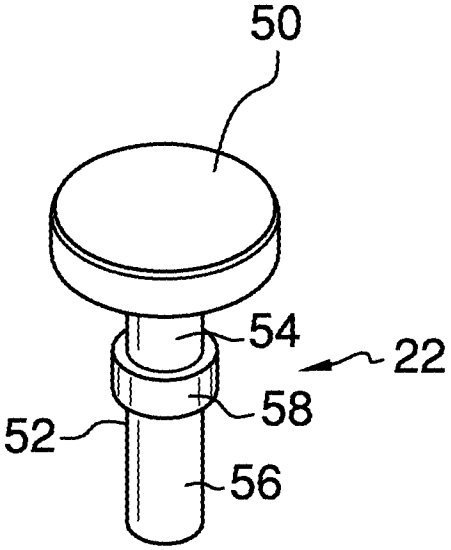
Figure 6B:
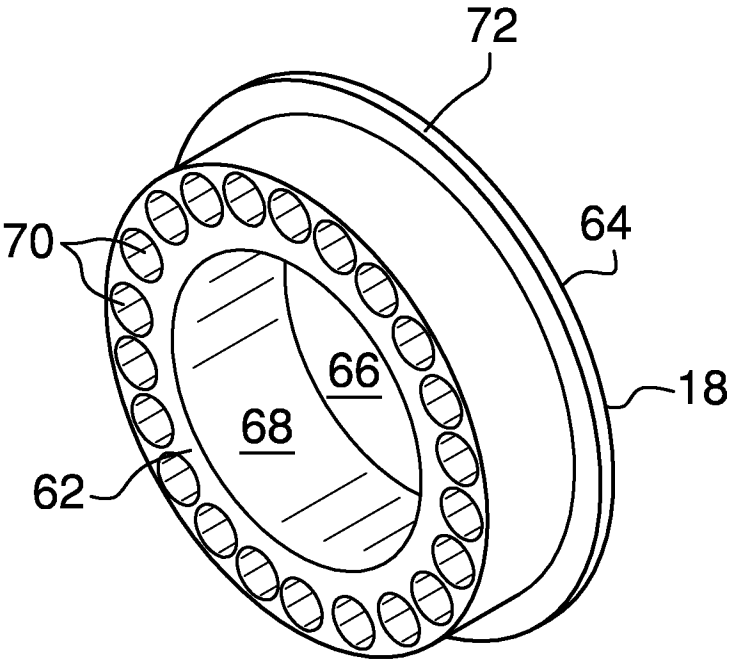
FIGS. 6*a-b* are views of the Receiver Adapter.
Figure 6A:
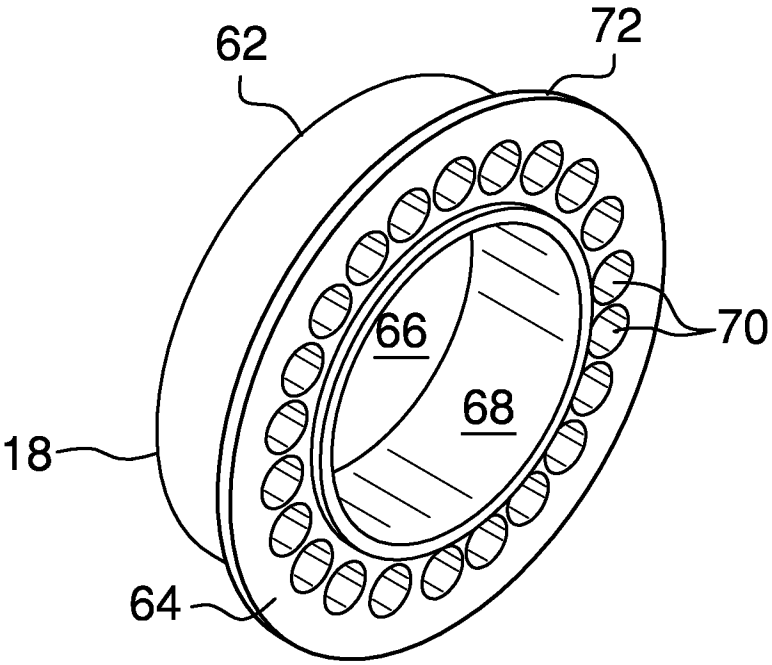
Figure 7B:
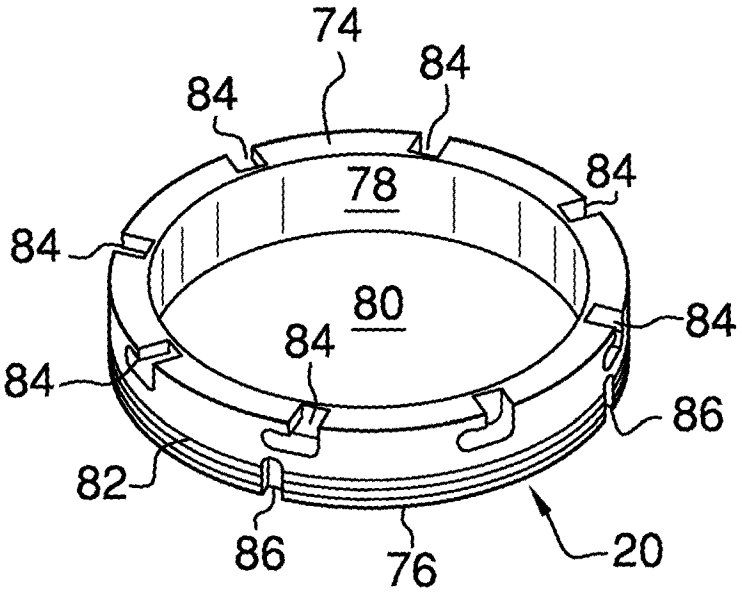
FIGS. 7*a-b* are views of the Lock Ring.
Figure 7A:
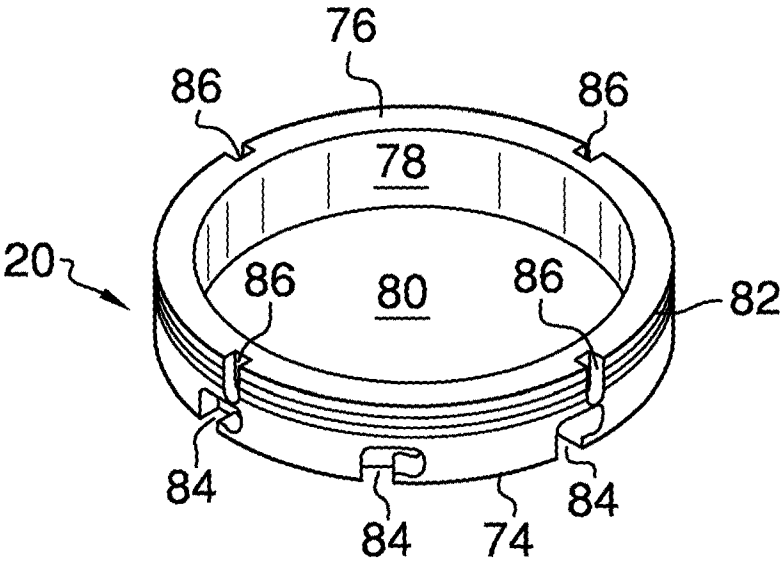
Figure 8:
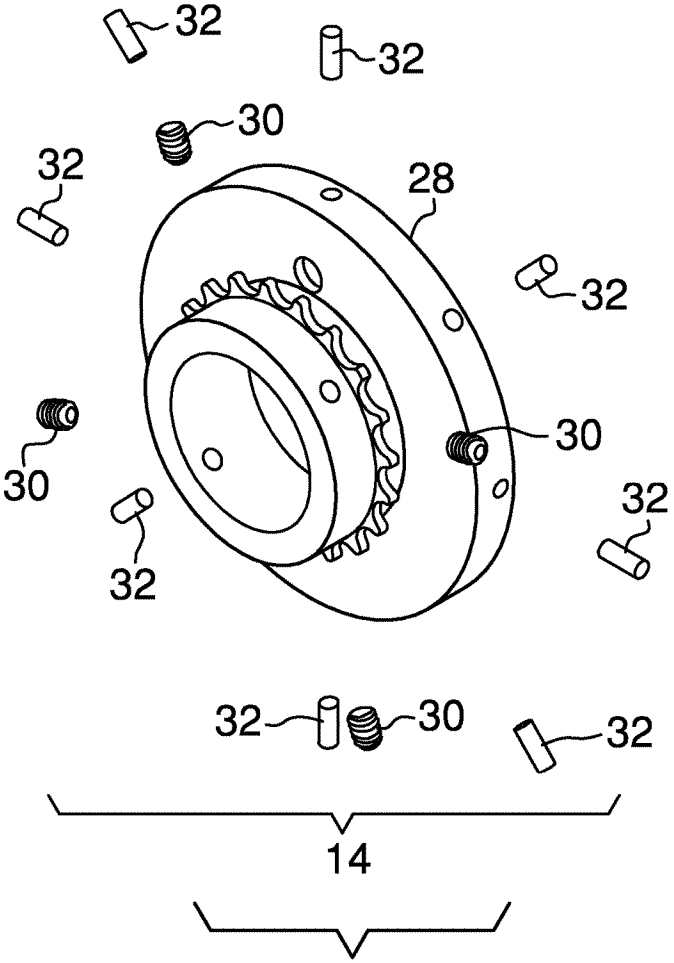
FIG. 8 is an exploded view of the Barrel Adapter Assembly.
Figure 9B:
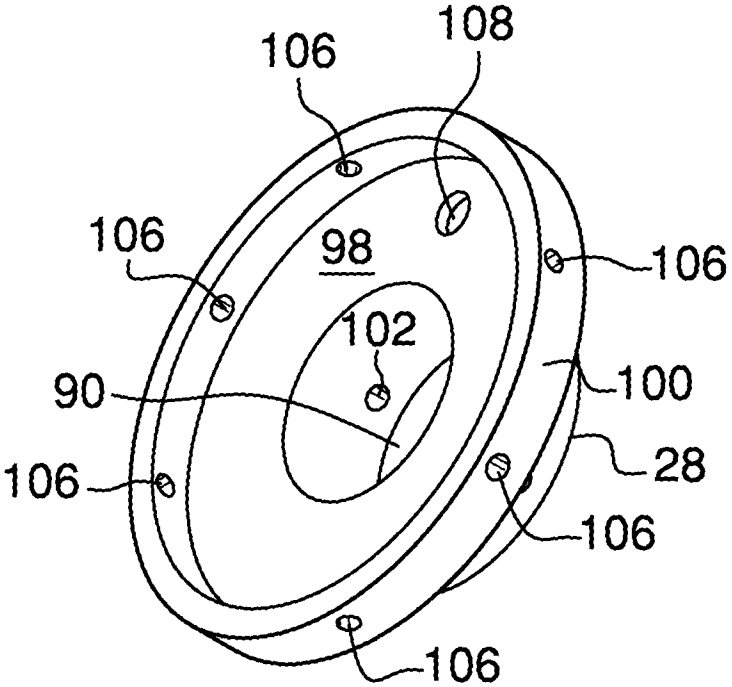
FIGS. 9*a-b* are views of the Barrel Adapter Assembly and its constituent parts.
Figure 9A:
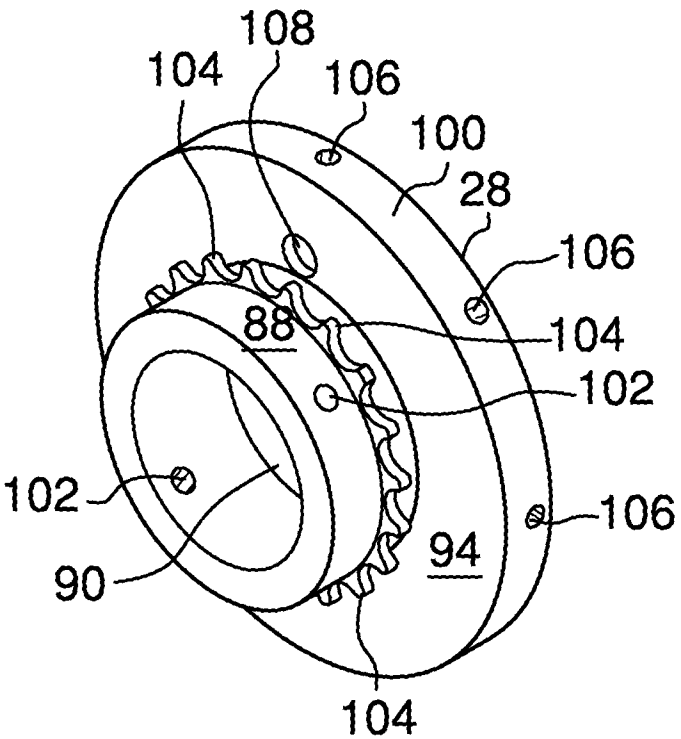

The present invention of a Quick Change Rifle Adapter System, denoted by the general reference 10, and show in use in FIGS. 1 and 2, and more fully illustrated in FIG. 3 is shown. The Quick Change Rifle Adapter System 10 comprises a Receiver Adapter Assembly 12, and a Barrel Adapter Assembly 14. The Receiver Adapter Assembly 12 includes a locking collar assembly 16, a receiver adapter 18, a lock ring 20, a locking pin 22, a spring 24, and a spring retainer 26. The Barrel Adapter Assembly 14 includes a barrel adapter 28, multiple set screws 30, and multiple locking lugs or dowels 32.

The locking collar 16 has a ring shaped body with an outer surface 34, an inner surface 36, and top face 38. The inner surface defines a through hole 40, and has a ridge or lip 42, which is perpendicular to the inner surface 36, and which extends along the entire circumference of the inner surface 36. The portion of the inner surface 36 which is between the ridge 42 and the top face 38 is milled with threads 44. The outer surface 34 of the locking collar 16 has 8 rectangular notches 46 which are evenly spaced around the circumference of the outer surface 34. The outer surface 34 of locking collar 16 also has an aperture 48 located equidistant between two of the notches 46. Aperture 48 is designed to secure a locking pin 22, a spring 24, and a spring retainer 26.

Locking pin 22 has a disk shaped head 50 with beveled upper and lower edges, and a perpendicular shaft 52. The shaft 52 has a solid body of two different diameters along its length with a transition zone in between, such that the upper half 54 has a larger diameter than the lower shaft 56, and the transition zone 58 comprises a rib having a diameter between that of the upper half 54 and the locking pin head 50.

Spring retainer 26 has a hollow cylindrical body with a bore 60 formed therethrough where the diameter of the bore 60 bottom exit is less than the bore 60 at the top entrance.

The locking pin 22 engages the lock ring 20 to lock and unlock the Barrel Adapter Assembly 14.

The receiver adapter 18 has a hollow cylindrical body with an upper surface 62, a lower surface 64, and a passage 66 having internal threads 68. The receiver adapter 18 also has a plurality of equally spaced gas tube clearance holes 70 which extend from the upper surface 62 to the lower surface 64. In addition, along the lower surface 64 a flange 72 extends perpendicularly to passage 66.

The lock ring 20 has a ring shaped body with an upper face 74, a lower face 76, an exterior surface 78, and smooth through hole 80. The exterior surface 78 of lock ring 20 has threads 82 around its circumference adjacent the lower surface 76 of lock ring 20. In addition the exterior surface 78 of lock ring 20 also has two distinct types of slots on opposing sides of the lock ring 20. Bayonet style, or "L"-shaped, lug locking slots 84 are on the upper face 74 side of the lock ring 20, and straight locking pin slots 86 are on the lower face 76 side of the locking ring. There are 8 lug locking slots 84 spaced equidistantly around the upper perimeter of locking ring 20. Likewise, the 4 locking pin slots 86 are located 90° from one another along the lower perimeter of locking ring 20.

The barrel adapter 28 comprises a unitary body having a cylindrical upper portion 88 with a borehole 90 and an outer surface 92, and an extended skirt 94, where the borehole 96 extends through the skirt 94 as well. The skirt 94 also has a flat upper surface 96, an underside 98, and a lip 100 which extends from the upper surface 96 of the skirt 94 below the underside 98 of the skirt 94. The cylindrical upper portion 88 of the barrel adapter 28 has multiple threaded apertures 102 on the outer surface 92 for holding set screws 30 and a ring of multiple scalloped projections 104, located along the midpoint of the outer surface 92 of the upper portion 88 of the barrel adapter 28. The lip 100 has multiple apertures or through-holes 106 for holding locking lugs 32, and a gas tube clearance hole 108.

In use, an AR-15 assault rifle is separated into the upper receiver and the barrel assembly portions, and the barrel is stripped. The Receiver Adapter Assembly 12 is assembled by first placing the lock collar 16 on the upper receiver of the rifle with the threaded side facing away from the upper receiver. The receiver adapter 18 is then oriented with the flange 72 of the receiver adapter 18 facing the upper receiver, and the lock ring 20 is oriented with the lower threaded surface 96 facing the upper receiver of the rifle, with the receiver adapter 18 positioned in between the lock ring 16 and the lock collar 20. The lock collar 20 and the lock ring 16 are then threaded onto the upper receiver of the rifle with the lock ring 16 over the lock collar 20 in a manner that allows the locking collar 20 to spin freely in place.

The Barrel Adapter Assembly 14 is assembled, by inserting the locking lugs 32 into the smooth apertures on the Barrel Adapter Assembly 14 and threading the set screws 30 into the threaded apertures 102 on the barrel adapter 28. The stripped barrel is inserted into the upper receiver, such that the barrel alignment pin is fully seated in the corresponding upper receiver alignment slot. The barrel is pushed into the upper receiver until the barrel abuts the face of the upper receiver. The Barrel Adapter Assembly 14 is slid on to the stripped barrel of the rifle with the locking lugs 32 are facing the barrel end, the set screws 30 are facing the muzzle end, and Barrel Adapter Assembly gas tube clearance hole 108 at the Top Dead Center (TDC) location.

In order to attach the Receiver Adapter Assembly 12 and the Barrel Adapter Assembly 14, the lock ring 20 is rotated until locking lugs 32 are aligned with the locking lug apertures 110. The Barrel Adapter Assembly 14 is then slid into the bayonet locking slots 90 of the lock ring 20 and the Barrel Adapter Assembly 14 is inserted into the Receiver Adapter Assembly 12 as far as possible. Light pressure is placed on the locking pin 22. The lock collar assembly 16 is rotated until the locking pin 22 engages the bayonet locking slots 84 on the lock ring 20. When the locking pin 22 engages the locking pin slot 86, the locking pin 22 is fully depressed and the lock collar assembly 16 is rotated until locked. Once locked, release the locking pin 22 and continue rotating the lock collar assembly 16 until it is hand tight. The gas tube 110 is slid through the Barrel Adapter Assembly gas tube clearance hole 108, a Receiver Adapter Assembly gas tube clearance hole 70, and the upper receiver gas tube clearance hole (not shown). If properly installed, the gas tube 110 should slide freely through and be aligned Top Dead Center (TDC) with the entire length of the AR barrel 112. The Barrel Adapter Assembly set screws 30 are tightened and the lock collar assembly 16 is finally tightened by hand or using a tool.

In order to remove the Quick Change Rifle Adapter System 10, remove the bolt/carrier assembly and the charging handle. Insert the AR barrel 112 with the Barrel Adapter Assembly 14 you desire to remove into the Receiver Adapter Assembly 12. Align the Barrel Adapter Assembly locking lugs 32 to the locking lug slots 84 in the lock ring 20. The Barrel Adapter Assembly is slid into the locking lug slots 84 and the locking pin 22 is lightly pressed to engage the lock ring 20. While lightly depressing the locking pin 22, the lock collar assembly 16 is rotated until the lock ring 20 engages the locking lugs 32. When the lock ring 20 engages, release the locking pin 22 is released and the lock collar assembly 16 is rotated until it is hand tight. The AR barrel 112 is then stripped. After the AR barrel has been stripped, the Barrel Adapter Assembly 14 is loosened and unlocked from the Receiver Adapter Assembly 12. The set screws 30 are loosened and the Barrel Adapter Assembly 14 is slid off the stripped AR barrel 112.

Switching between multiple calibers requires installed Rifle Adapter Assemblies 10 on each barrel and receiver. Once the Rifle Adapter Assembly has been initially installed, the following steps can be followed to switch between barrel assemblies.

It is important to note that the AR-15 is capable of firing different calibers, and that some calibers require using not only a different barrel, but a different bolt and/or a different magazine. In addition, some calibers may also require different buffers, buffer springs or entire bolt carrier assemblies.

In order to switch barrel assemblies that utilize the same bolt, initially lock the bolt to the rear of the action. The lock collar 16 is then unscrewed. Once the lock collar 16 begins to loosen, light pressure is placed on the locking pin 22 while continuing to loosen the Lock collar 16. When the locking pin 22 engages the lock ring pin slot 90, fully depress the locking pin 22 and continue rotating in the same direction to unlock the Quick Change Rifle Adapter System 10. The locking and unlocking requires less than a ¼" of movement in either direction once the locking pin 22 is engaged.

The entire barrel assembly is removed from the AR upper receiver by pulling it away from the AR receiver. The new barrel assembly is installed by lining the gas tube Top Dead Center (TDC) to the Top Dead Center (TDC) Receiver Adapter gas tube clearance hole 70 and inserting the barrel extension into the receiver. The Barrel Adapter Assembly locking lugs 32 are aligned with the locking slots 88 on the lock, ring 20. The barrel is then fully seated into the AR receiver. The lock collar 16 is tightened while placing light pressure on the locking pin 22. When the locking pin 22 engages the lock ring locking pin slot 86, fully depress the locking pin 22 and continue rotating in the same direction to lock the Quick Change Rifle Adapter System 10. The locking and unlocking requires less than a ¼" of movement in either direction once the locking pin 22 is engaged. Release the locking pin 22 and continue to tighten the lock collar 16 until it will not tighten any more.

In order to switch barrel assemblies that require different bolts, initially, lock the bolt to the rear of the action. The lock collar 16 is turned to unscrew the Quick Change Rifle Adapter System 10. Once the lock collar 16 begins to loosen, place light pressure on the locking pin 22 while continuing to loosen the lock collar 16. When the locking pin 22 engages the lock ring 20 locking pin slot 86, the locking pin 22 is fully depressed and the lock ring 20 rotated in the same direction to unlock the Quick Change Rifle Adapter System 10. The locking and unlocking requires less than a ¼" of movement in either direction once the locking pin 22 is engaged. The entire AR barrel assembly is removed from the AR receiver by pulling it away from the AR receiver. After removing the AR barrel assembly, separate the AR upper and lower receivers. This can be done by pulling one or both receiver takedown pins.

The bolt carrier assembly is removed and the bolt is changed. With the new bolt in the upper receiver, the AR upper and lower receiver are reassembled. The new barrel assembly is installed by lining the gas tube 110 Top Dead Center (TDC) to the TDC Receiver Adapter gas tube clearance hole 70 and inserting the barrel extension into the receiver. Align the Barrel Adapter Assembly locking lugs 32 with the locking lug slots 84 on the lock ring 20. The barrel assembly is fully seated into the AR receiver. The lock collar 16 is tightened while light pressure is placed on the locking pin 22. When the locking pin 22 engages the lock ring locking pin slot 86, the locking pin 22 is fully depressed and the locking collar 16 is rotated in the same direction to lock the Quick Change Rifle Adapter System 10. The locking and unlocking requires less than a ¼" of movement in either direction once the locking pin 22 is engaged. The locking pin 22 is released and the lock collar 16 is tightened.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A quick change rifle adapter system for an upper receiver and a barrel of an assault rifle, comprising in combination: an assembly connected to the upper receiver of the rifle comprising a locking collar having a ring-shaped body with an outer surface having an aperture defined therethrough, an inner surface having a passage defined therethrough, a ridge formed perpendicular to the inner surface and a top face; a receiver adapter having a cylindrical body with a passage defined therethrough, an upper surface, a lower surface, and a flange defined along the lower surface extending perpendicular to the passage; a lock ring having a body with an inner surface defining a passage, an outer surface having an upper peripheral portion and a threaded lower peripheral portion, and a series of equidistantly spaced L-shaped slots defined around the upper peripheral portion; a barrel adapter attached to the barrel of the rifle having a body with a passage defined therethrough, a skirt depending outwardly from the body having a peripheral surface with a series of apertures having a smooth inner surface integrally formed therein, and a series of lugs to frictionally fit in the apertures of the skirt; and whereby the barrel adapter is securely engaged to the assembly by aligning the lugs of the barrel adapter with the slots of the lock ring of the assembly.

2. The system of claim 1, whereby a locking pin secured through the aperture of the locking collar of the assembly to engage the lock ring of the assembly.

3. The system of claim 2, further comprising a spring and spring retainer complementary with the locking pin.

4. The system of claim 3, whereby the locking ring has a set of straight slots, formed at a right angle to the threaded lower peripheral portion of the locking ring of the assembly, positioned equidistantly along the locking ring, and dimensioned to accept the locking pin of the locking collar.

5. The system of claim 4, whereby the cylindrical upper portion of the barrel adapter has a series of apertures integrally formed on an outer surface, and further comprising set screws insertable into the cylindrical upper portion of the barrel adapter for securing the adapter to the barrel of the rifle.

6. A quick change rifle adapter system for an upper receiver and a barrel of an assault rifle, comprising in combination:

- an assembly connected to the upper receiver of the rifle comprising
  - a locking collar having a ring-shaped body with an outer surface having an aperture defined therethrough, an inner surface having a passage defined therethrough, a ridge formed perpendicular to the inner surface and a top face;
  - a receiver adapter having a cylindrical body with a passage defined therethrough, an upper surface, a lower surface, and a flange defined along the lower surface extending perpendicular to the passage;
  - a lock ring having a body with an inner surface defining a passage, an outer surface having an upper peripheral portion and a threaded lower peripheral portion, and a series of equidistantly spaced L-shaped slots defined around the upper peripheral portion;
- a barrel adapter attached to the barrel of the rifle having a cylindrical upper portion with a first series of apertures integrally formed on an outer surface, a skirt depending outwardly from the upper portion having a peripheral surface with a second series of apertures having a smooth inner surface integrally formed therein, and a series of lugs to frictionally fit in the apertures of the skirt of the barrel adapter;
- set screws insertable into the first series of apertures of the cylindrical upper portion of the barrel adapter for securing the adapter to the barrel of the rifle; and
- whereby the barrel adapter is securely engaged to the assembly by aligning the lugs of the barrel adapter with the slots of the lock ring of the assembly.

7. The system of claim 3, whereby the receiver adapter of the assembly has a plurality of gas clearance holes defined therein extending from the upper surface to the lower surface.

* * * * *